US007107002B2

(12) United States Patent
Saito et al.

(10) Patent No.: US 7,107,002 B2
(45) Date of Patent: Sep. 12, 2006

(54) TONER COLLECTION APPARATUS

(75) Inventors: Takashi Saito, Tokyo (JP); Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/638,415

(22) Filed: Aug. 12, 2003

(65) Prior Publication Data

US 2004/0033094 A1 Feb. 19, 2004

(30) Foreign Application Priority Data

Aug. 12, 2002 (JP) ..... 2002-2535036

(51) Int. Cl.
*G03G 21/12* (2006.01)

(52) U.S. Cl. ..... 399/360

(58) Field of Classification Search ..... 399/358, 399/359, 360

See application file for complete search history.

(56) References Cited

U.S. PATENT DOCUMENTS 5,138,386 A * 8/1992 Okano et al. ..... 399/62

FOREIGN PATENT DOCUMENTS

| | | | |
|---|---|---|---|
| JP | H02-199495 | | 8/1990 |
| JP | 02282777 | A * | 11/1990 |
| JP | H03-26170 | | 3/1991 |
| JP | H03-59585 | | 3/1991 |
| JP | 03182789 | A * | 8/1991 |
| JP | H06-186843 | | 7/1994 |
| JP | H07-43705 | | 9/1995 |
| JP | 08160822 | A * | 6/1996 |
| JP | H10-301460 | | 11/1998 |
| JP | 2001209286 | A * | 8/2001 |
| JP | 2002123143 | A * | 4/2002 |

* cited by examiner

*Primary Examiner*—Arthur T. Grimley
*Assistant Examiner*—Ryan Gleitz
(74) *Attorney, Agent, or Firm*—Rabin & Berdo, P.C.

(57) ABSTRACT

In order to collect sufficiently the toner in the toner collecting section so as to prevent the toner from overflowing from the toner collecting section, a toner collection apparatus is provided. The toner collection apparatus comprises a removing member for removing the toner in the toner carrier; a toner collecting section which is used for collecting the toner and has displacement section displaced corresponding to the piled amount of the toner; and the detecting section for detecting the displacement of the displacement section.

21 Claims, 14 Drawing Sheets

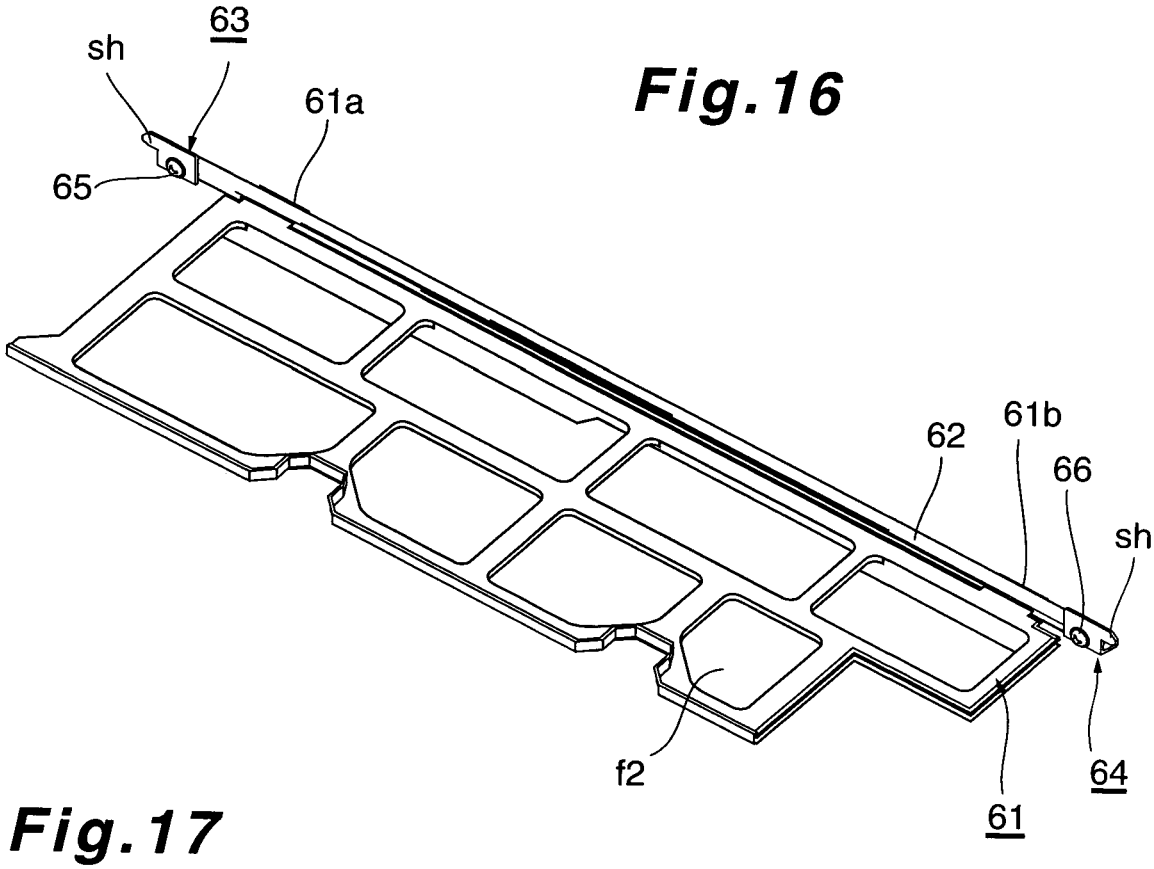
Fig.16
Fig.17
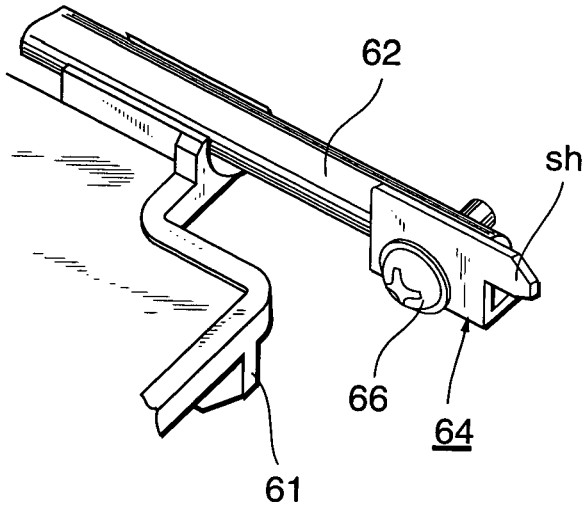

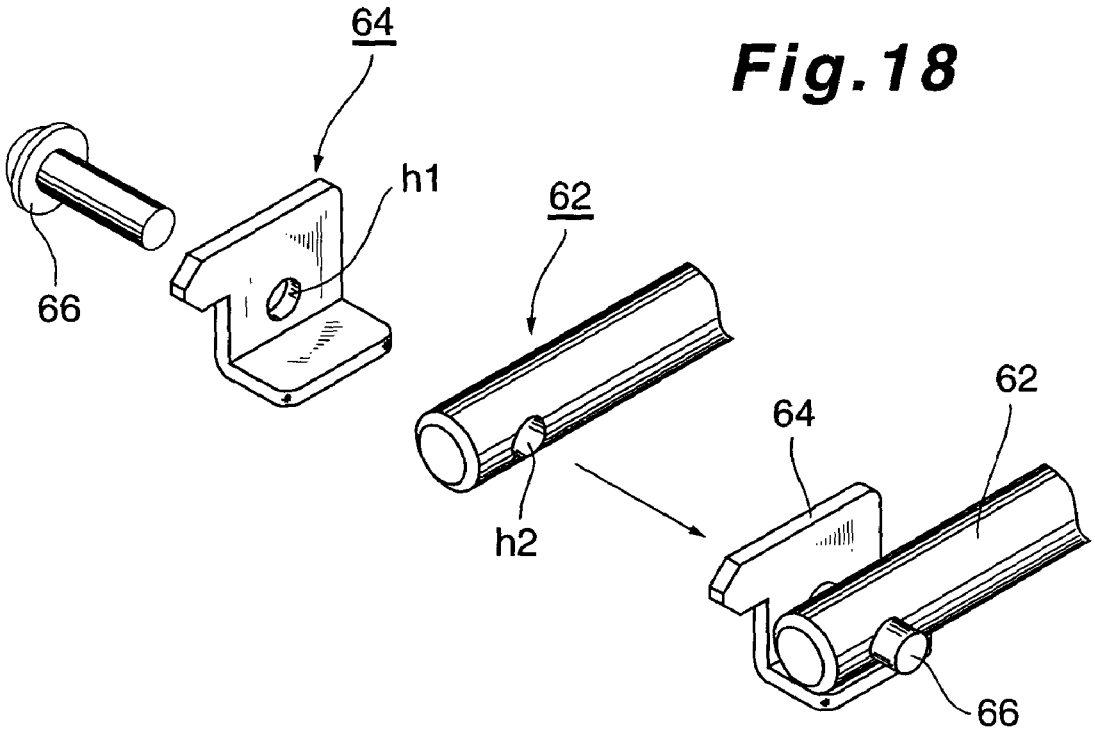
Fig.18
Fig.19
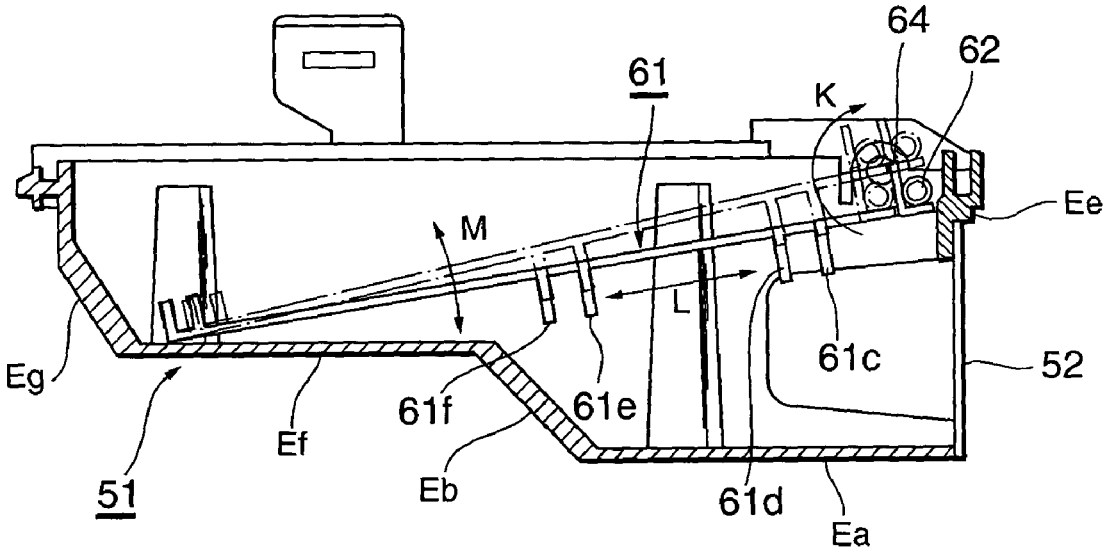

TONER COLLECTION APPARATUS

BACKGROUND OF THE INVENTION

1. Field of the Invention

The invention relates to an toner collection apparatus.

2. Related Background Art

Conventionally, in image recording apparatus, for example, printing device with electrophotography, copying device or facsimile device, in order to record an image, first forming a electrostatic latent image by using a LED (Light Emitting Diode) head to expose the surface of photoconductor drum electrified uniformly and equally, then forming a toner image by using a image developing device to developing the electrostatic latent image, further transferring the toner image on sheet by using a transference device, moreover recording an image by using a fixing device to fix the toner image on the sheet.

After transference, the disused toner remaining on the surface of the photoconductor drum, serving as waste toner, is removed by a cleaning device and collected into collection box. Then, the toner collected is dumped or is reused by being provided to the image developing device.

Also, in a color image recording apparatus with tandem form, a conveyance belt with endless is made moving; image forming units of cyan, magenta, yellow and black are set along the moving direction of the conveyance belt; and transferring rollers are set respectively toward each image forming unit for sandwiching the conveyance belt.

In each image forming unit, first forming a electrostatic latent image by using a LED (Light Emitting Diode) head to expose the surface of photoconductor drum electrified uniformly and equally, then forming a single-color toner image by using a image developing device to developing the electrostatic latent image.

Then, conveying sheet by the conveyance belt and forming a color toner image by using a transference device to transfer each single-color toner images on the sheet, moreover recording a color image by using a fixing device to fix the color toner image on the sheet.

In such image recording apparatus, if any one of the image forming units is not at the right place, when forming the color toner image, the color deviation will happen. Therefor, forming directly each single-color image on the conveyance belt, then detecting respective places by using image detecting sensor, further amending the deviation among single-color images. In this case, after amendment, because toners respectively used for constructing each single-color image formed on the conveyance belt become disused, it is necessary to remove the disused toner.

Moreover, In such image recording apparatus, with respect to construction, because each image forming unit is set such as contacting with the conveyance belt, the toner of the image forming unit is stuck easily on the conveyance belt. In particular, in this case that using such sheet with narrow size (for example, a postal card or an envelope or the like), the toner on the area which does not corresponds to the sheet, is also stuck easily on the conveyance belt.

Therefor, the collection box assembly for waste toner is set along the conveyance belt, the waste toner, after being collected, is dumped.

FIG. 2 is a squint drawing showing a conventional conveyance belt unit, FIG. 3 is a squint drawing showing a conventional collection box assembly, FIG. 4 is a cross sectional view on the A—A position of FIG. 3, FIG. 5 is a squint drawing showing an installing state of a conventional stirring bar.

As shown by FIG. 2, the conveyance belt unit 10 comprises a driving roller Ra, a subordinate roller Rb, a conveyance belt 12 with endless which is set between the driving roller Ra and the subordinate roller Rb, and a collection box assembly 11 for collecting the toner 18*a* serving as waste toner 18 on the conveyance belt 12.

The collection box assembly 11, as shown by FIGS. 3 and 4, comprises a box 13 for collecting the toner 18, a blade 14 for scraping up the toner 18*a* on the conveyance belt 12 moving along an arrow direction a, a film 15 for preventing the scraped toner from being scattered, a cover 16, a stirring bar 17 and a gear 19 for making the stirring bar rotate.

The waste toner 18 scraped up by the blade 14, is stirred by the stirring bar 17 which rotates along an arrow direction b and is controlled by a driving system (which is not shown) and is set under the blade 14, and is piled up in the box 13.

However, in the conventional collection box assembly 11, when repeating the image records, a lot of the waste toner 18 is piled up just under the stirring bar 17, there is a possibility of that the waste toner 18 overflows the box 13. Therefor, it is impossible to sufficiently collect the waste toner 18.

SUMMARY OF THE INVENTION

To solve the conventional problems as mentioned above, the present invention supplies an toner collection apparatus capable of sufficiently collecting the waste toner.

According to the invention, there is provided one toner collection apparatus, comprising:

a removing member for removing the toner in the toner carrier;

a toner collecting section which is used for collecting the toner and has displacement section displaced corresponding to the piled amount of the toner; and a detecting section for detecting the displacement of the displacement section.

In the toner collection apparatus, the toner collecting section may include a frame; and a bag-shape section which is made up of a supple material and surrounds the frame.

Further, the displacement section may be formed from the bag-shape section.

Further, the toner collecting section may include a box-shape section; and a inserting member which is made up of a supple material and inserts into the box-shape section, and the displacement section may be formed from the inserting member.

The toner collection apparatus may further comprise a stirring member which rocks freely in the toner collecting section.

Further, in the toner collection apparatus, the stirring member may be set slantly, the upper end of the stirring member may be supported by a axis unit with crank axis shape, the stirring member may be made rocking by the rotation of the axis unit.

Further, on one hand, the axis unit may be made up of a shaft body and a connecting section formed to the shaft body in a body.

Further, on the other hand, the axis unit is made up of a shaft and a connecting section installed at the two ends of the shaft. In this case, the connecting section may have a rotation axis portion formed such as deviating from the center of the shaft.

According to the invention, there is provided an other toner collection apparatus, comprising:

a conveyance member contacting with a image forming unit;

a removing member for removing the toner on the conveyance member;

a toner collecting section which is used for collecting the toner and has displacement section displaced corresponding to the piled amount of the toner; and a detecting section for detecting the displacement of the displacement section.

In the toner collection apparatus, the toner collecting section may include a frame; and a bag-shape section which is made up of a supple material and surrounds the frame.

Further, the displacement section may be formed from the bag-shape section.

Further, the toner collecting section may include a box-shape section; and a inserting member which is made up of a supple material and inserts into the box-shape section, and the displacement section may be formed from the inserting member.

The toner collection apparatus may further comprise a stirring member which rocks freely in the toner collecting section.

Further, in the toner collection apparatus, the stirring member may be set slantly, the upper end of the stirring member may be supported by a axis unit with crank axis shape, the stirring member may be made rocking by the rotation of the axis unit.

Further, on one hand, the axis unit may be made up of a shaft body and a connecting section formed to the shaft body in a body. Further, on the other hand, the axis unit is made up of a shaft and a connecting section installed at the two ends of the shaft. In this case, the connecting section may have a rotation axis portion formed such as deviating from the center of the shaft.

The above and other objects and features of the present invention will become apparent from the following detailed description and the appended claims with reference to the accompanying drawings.

BRIEF DESCRIPTION OF THE DRAWINGS

FIG. 16 is a squint drawing showing a stirring member of the present invention in embodiment 3;

FIG. 17 is a squint drawing showing the main portion of a stirring member of the present invention in embodiment 3;

FIG. 18 is a squint drawing showing the installing state of a second connection section of the present invention in embodiment 3;

FIG. 19 is a cross sectional view showing a stirring member of the present invention in embodiment 3;

DETAILED DESCRIPTION OF THE PREFERRED EMBODIMENTS

With respect to embodiments of the present invention, while referring to diagrams, the following is to explain them in detail.

In embodiments, serving as an image recording apparatus, a color printing apparatus with tandem form is explained. Moreover, the present invention, not only can be applied to the monochromatic and color printing apparatuses of other forms except tandem, but also can be applied to the other apparatus except the printing apparatus, for example, copying apparatus or facsimile apparatus or the like.

Embodiment 1

Figure 6:
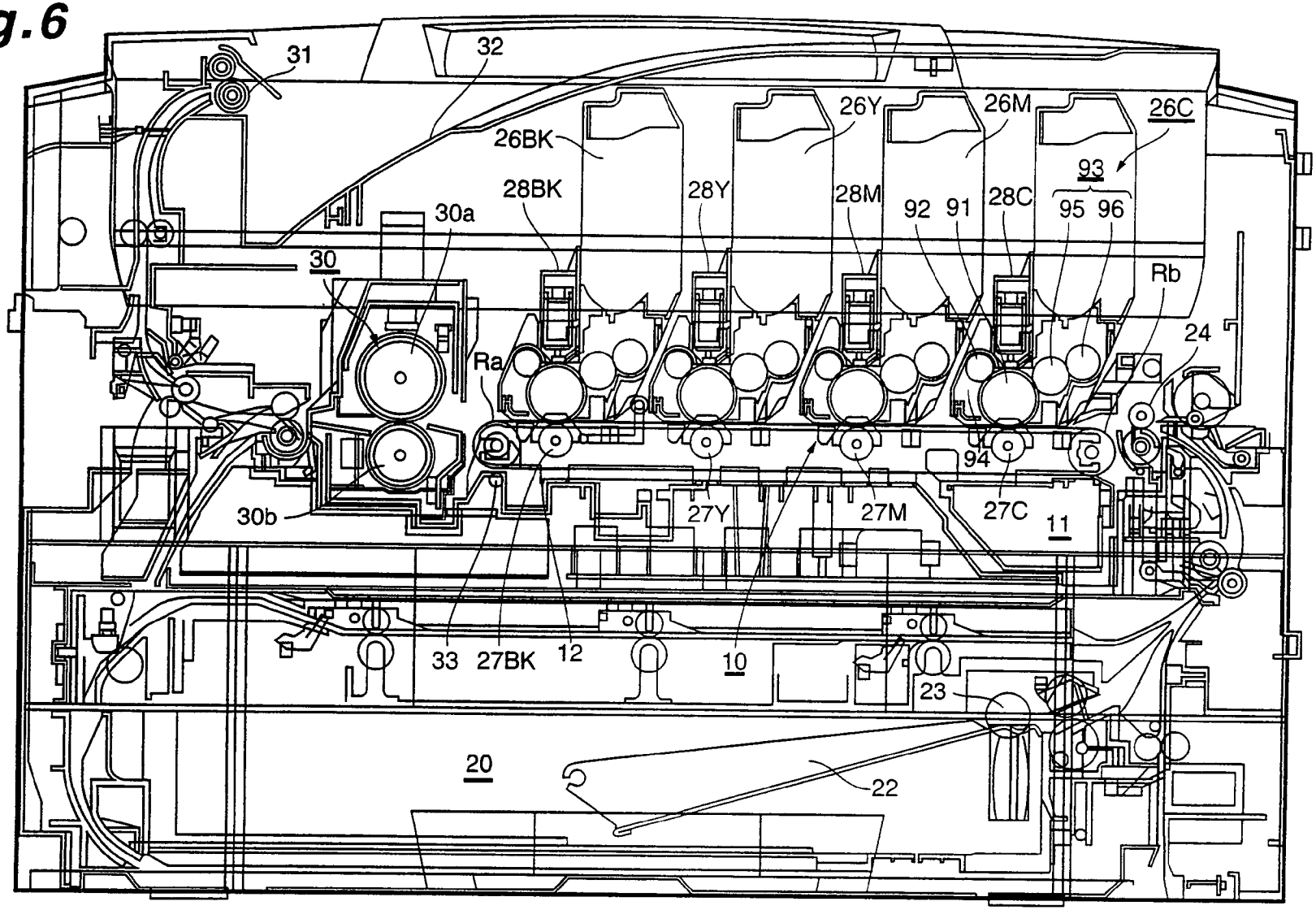
FIG. 6 is a summary diagram showing a printing apparatus of the present invention in embodiment 1.

FIG. 6 is a summary diagram showing a printing apparatus of the present invention in embodiment 1.

As shown by FIG. 6, a medium storing section 20 is set at the under portion of the printing apparatus. The medium storing section 20 comprises a medium cassette 22 for storing sheets (not shown) as recording medium. The sheets are sent out one by one by a sheet providing roller 23 from the medium cassette 22 to a resisting roller 24. When the resisting roller 24 becomes rotating, the sheet is sent to a conveyance belt 12 serving as a endless toner carrier.

The conveyance belt 12 is set between the driving roller Ra and the subordinate roller Rb, and is moved by a driving supply (not shown). Under the subordinate roller Rb, a collection box assembly 11 is set. The driving roller Ra, the subordinate roller Rb, the conveyance belt 12 and the collection box assembly 11 constructed conveyance belt unit 10.

Along the moving direction of the conveyance belt 12, image forming units 26C, 26M, 26Y and 26B of cyan, magenta, yellow and black, are respectively set. In order to sandwich the conveyance belt 12, transferring rollers 27C, 27M, 27Y and 27B are set respectively toward image forming units 26C, 26M, 26Y and 26B. Further, over the image forming units 26C, 26M, 26Y and 26B, LED (Light Emitting Diode) heads 28C, 28M, 28Y and 28B as exposing units are set.

The any one of the image forming units 26C, 26M, 26Y and 26B comprises a photoconductor drum 91 serving as toner carrier and image carrier; a charging roller 92 serving as a charging device which charges uniformly and equally the photoconductor drum 91; a image developing device 93 for developing the corresponding electrostatic latent image formed by the LED head 28 (28C, 28M, 28Y or 28B) and forming the toner image corresponding to one of colors; and a cleaning device 94 for removing the disused toner (not shown) left on the surface of the photoconductor drum 91. The image developing device 93 includes a developing roller 95 which is set such as contacting with the photoconductor drum 91 and serves as toner carrier, and a toner providing roller 96 for providing the toner to the developing roller 95.

While a sheet conveyed by the conveyance belt 12 is charged statically by a adsorbing device, and is adsorbed on the conveyance belt by the static electricity, then is sent by the conveyance belt, in the image forming units 26C, 26M, 26Y and 26B, the respective electrostatic latent images formed on each photoconductor drum 91 are developed by respective developing devices 93, and the toner images of cyan, magenta, yellow and black are formed. Further, the toner images of cyan, magenta, yellow and black are transferred onto the sheet by the transferring rollers 27C, 27M, 27Y and 27B. Then, a color toner image is formed.

Further, the sheet on which the color toner image is transferred, is sent by the fixer 30 serving as fixing device, and passes through between the heating roller 30*a* and pressing roller 30*b* that construct the fixer 30. Thus, the color toner image is fixed on the sheet. As a result, a color image is recorded. Moreover, the sheet on which the color image has been recorded, is ejected to the stack 32 by the ejecting roller 31.

In such printing apparatus, if any one of the image forming units 26C, 26M, 26Y and 26B is not at the right place, when forming the color toner image, the color deviation will happen. Therefor, forming directly each single-color image on the conveyance belt 12, then detecting respective places by using image detecting sensor 33, further amending the deviation among single-color images. In this case, after amendment, because toners respectively used for constructing each single-color image formed on the conveyance belt 12 become disused, it is necessary to remove the disused toner.

Moreover, In such image recording apparatus, with respect to construction, because each image forming unit 26 (26C, 26M, 26Y or 26B) is set such as contacting with the conveyance belt 12, the toner of the image forming unit sticks easily on the conveyance belt. In particular, in this case that using such sheet with narrow size (for example, a postal card or an envelope or the like), the toner on the area which does not corresponds to the sheet, also sticks easily on the conveyance belt 12.

Therefor, the collection box assembly for waste toner is set along the conveyance belt, the waste toner, after being collected, is dumped.

Figure 1:
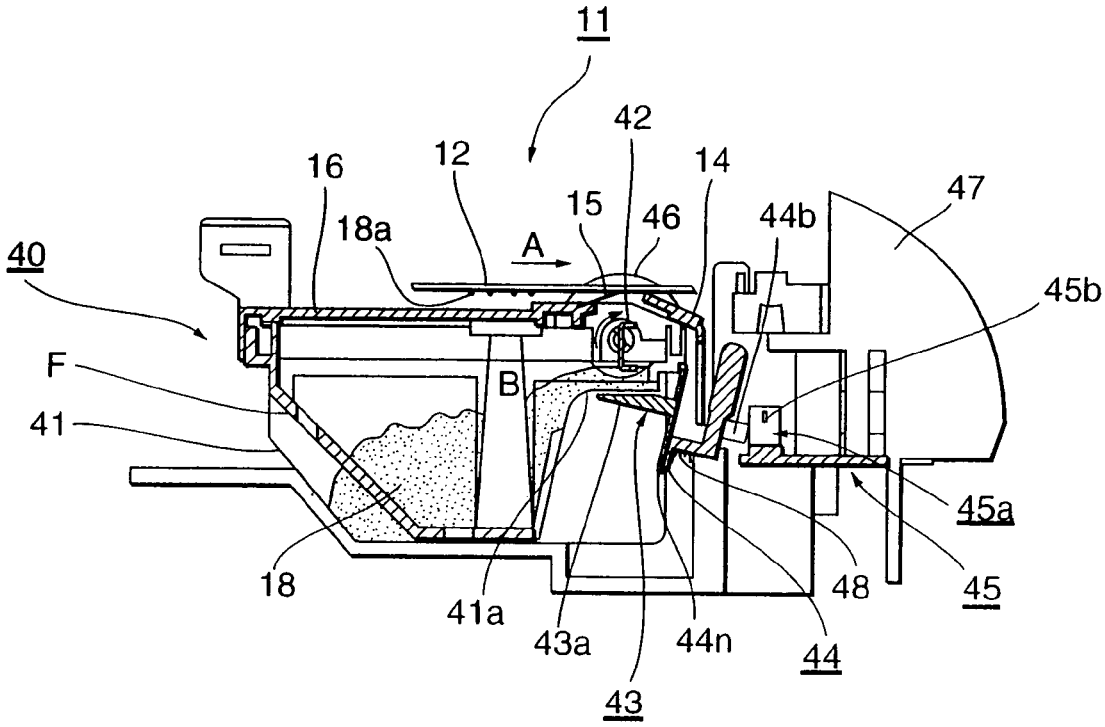
FIG. 1 is a cross sectional view showing an collection box assembly of the present invention in embodiment 1.
Figure 2:
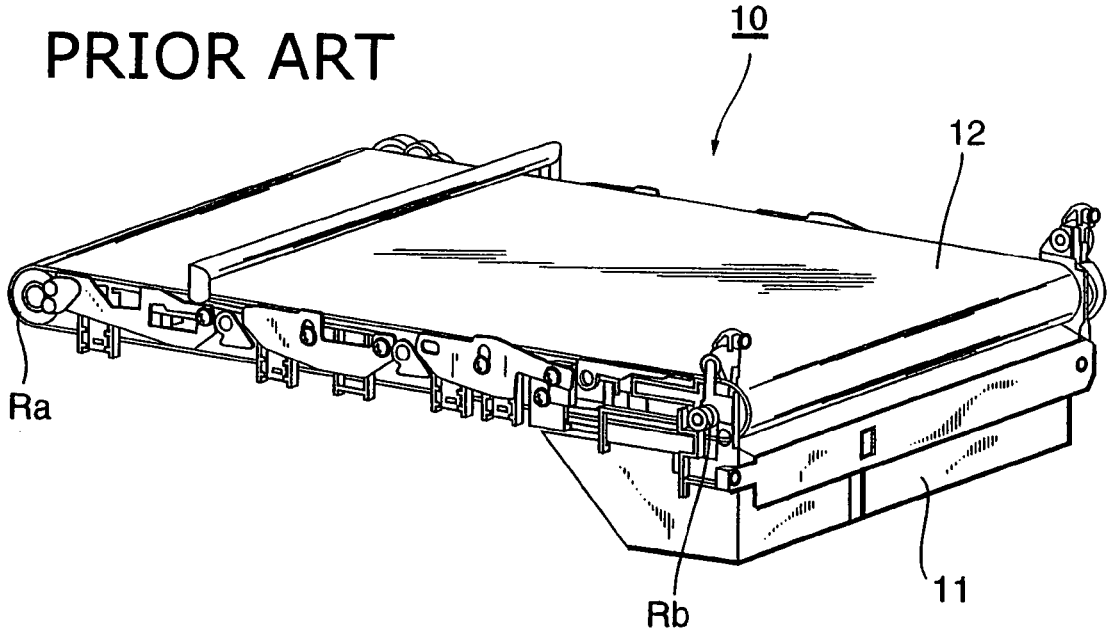
Fig.2 PRIOR ART
FIG. 2 is a squint drawing showing a conventional conveyance belt unit.
Figure 3:
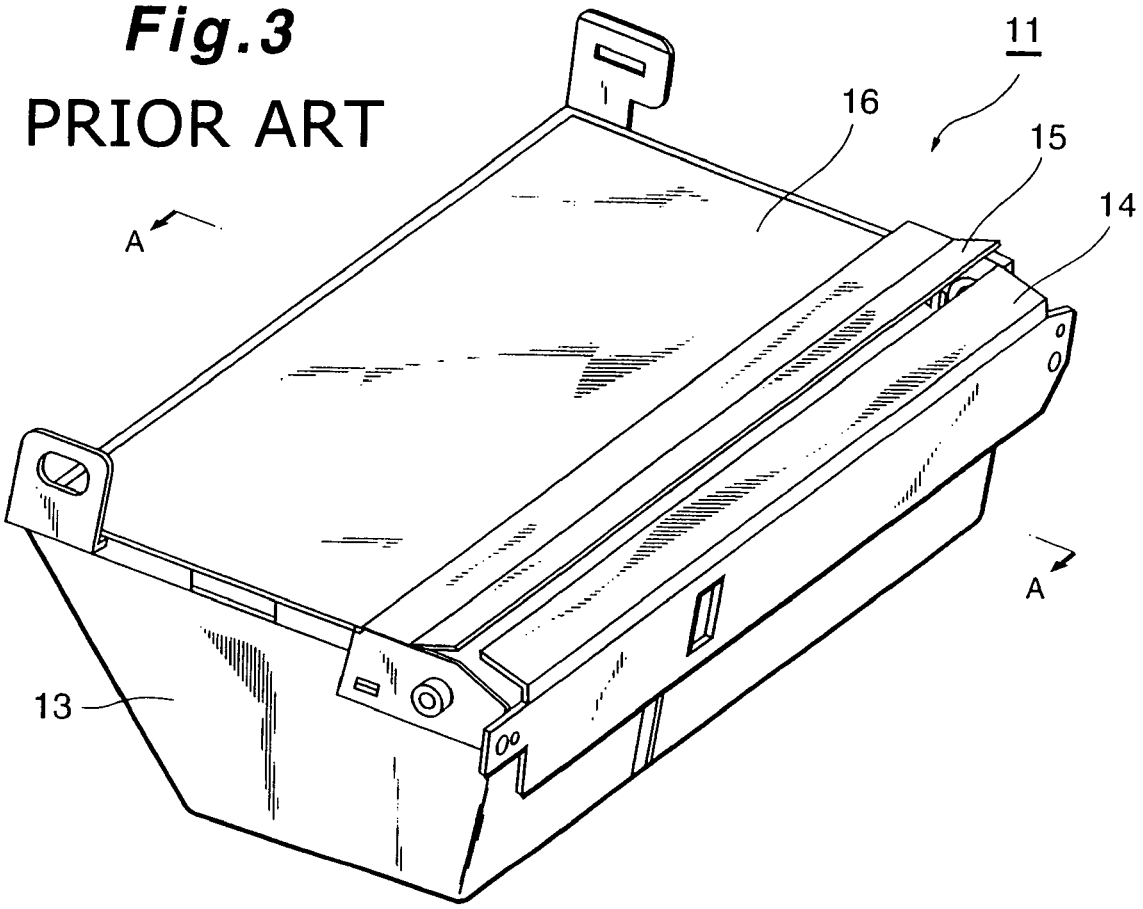
Fig.3 PRIOR ART
FIG. 3 is a squint drawing showing a conventional collection box assembly.
Figure 4:
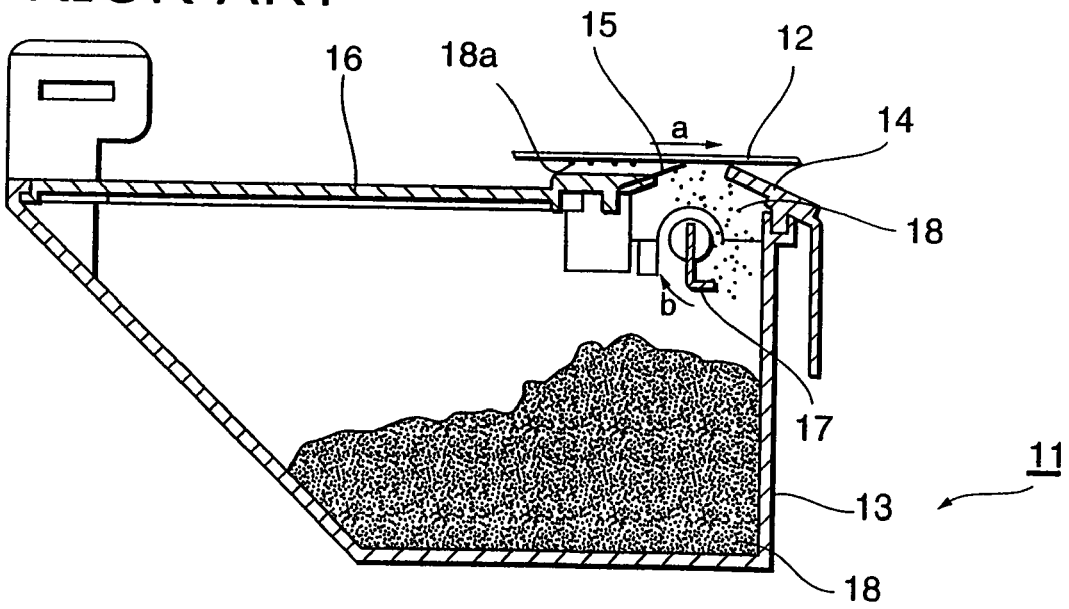
Fig.4 PRIOR ART
FIG. 4 is a cross sectional view on the A—A position of FIG. 3.
Figure 5:
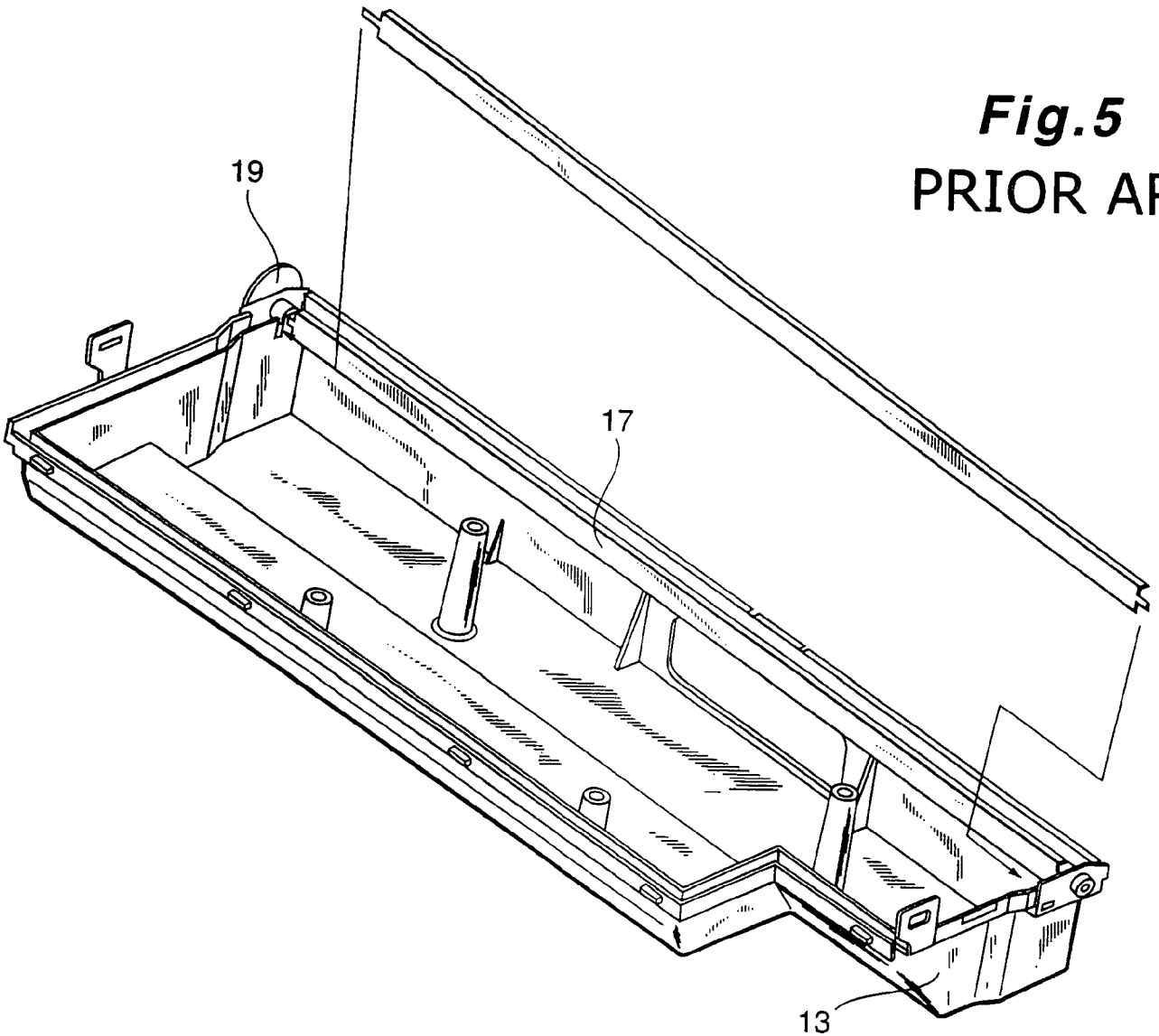
Fig.5 PRIOR ART
FIG. 5 is a squint drawing showing an installing state of a conventional stirring bar.
Figure 7:
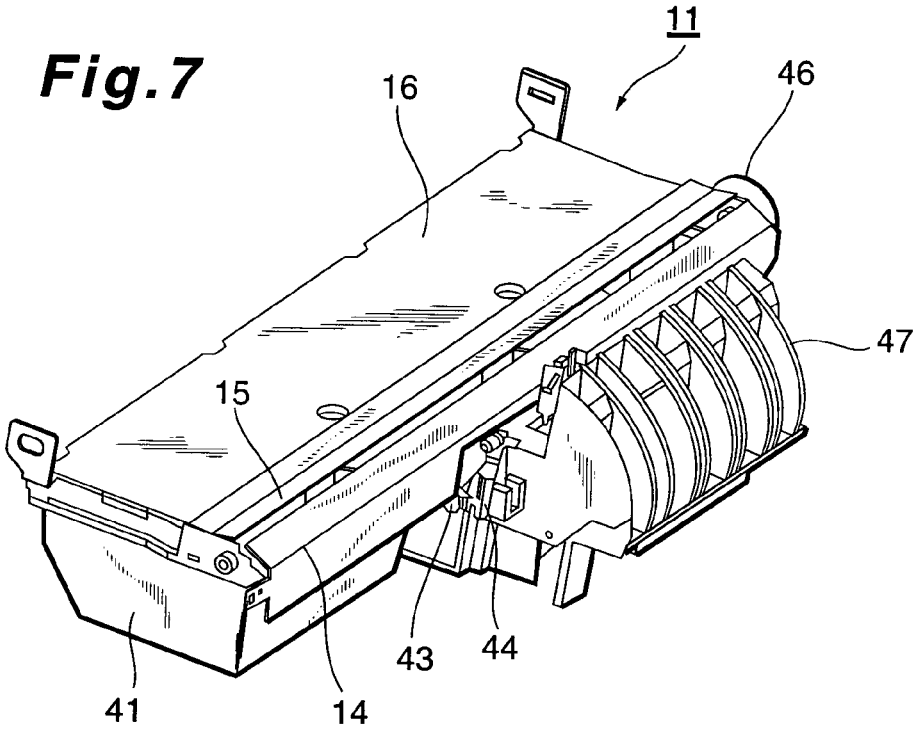
FIG. 7 is a squint drawing showing a collection box assembly of the present invention in embodiment 1.
Figure 8:
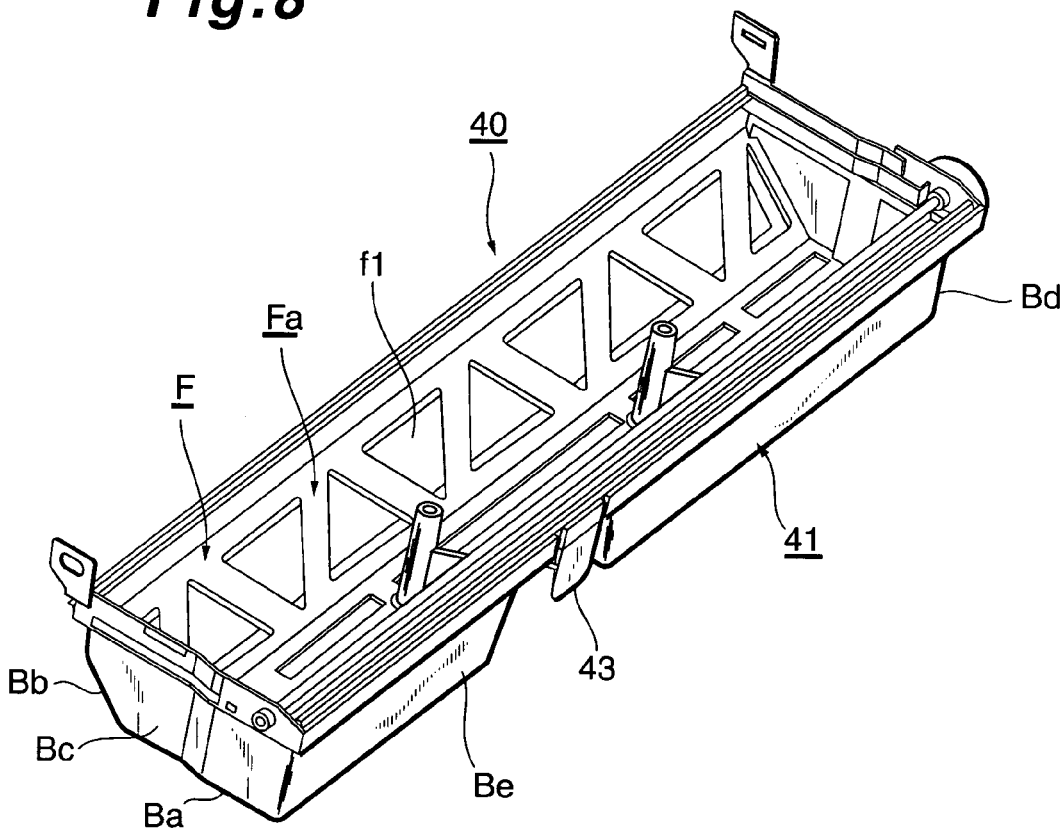
FIG. 8 is a first squint drawing showing a toner collecting section of the present invention in embodiment 1.
Figure 9:
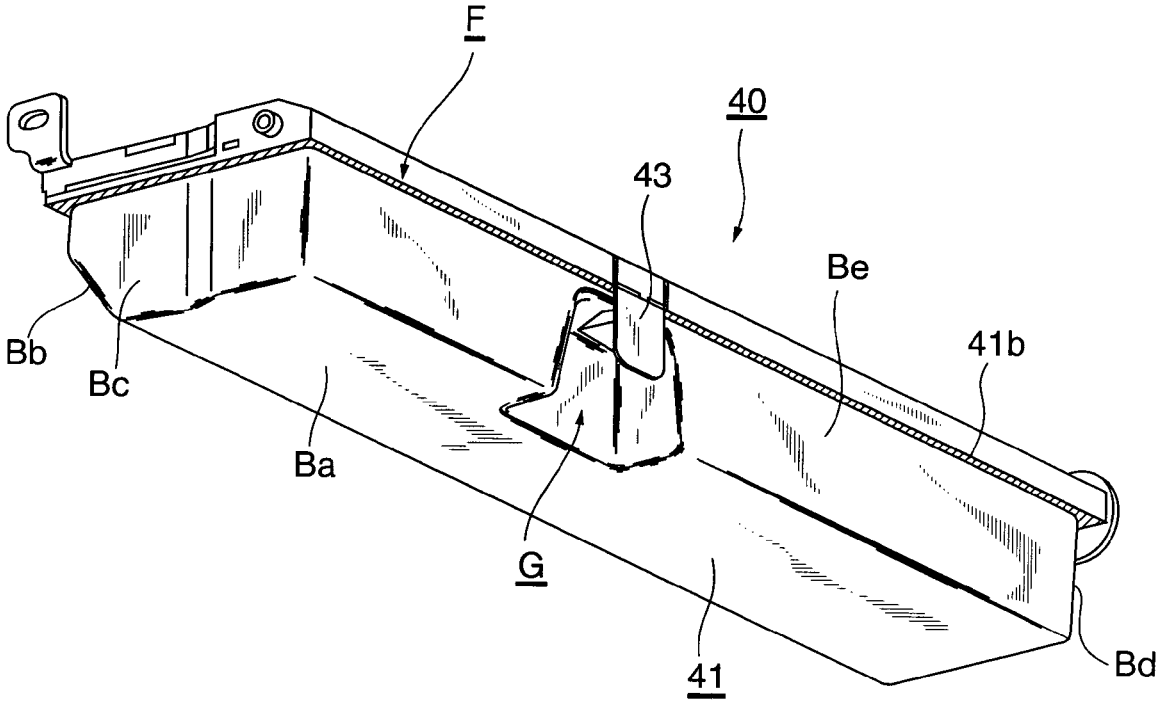
FIG. 9 is a second squint drawing showing a toner collecting section of the present invention in embodiment 1.
Figure 10:
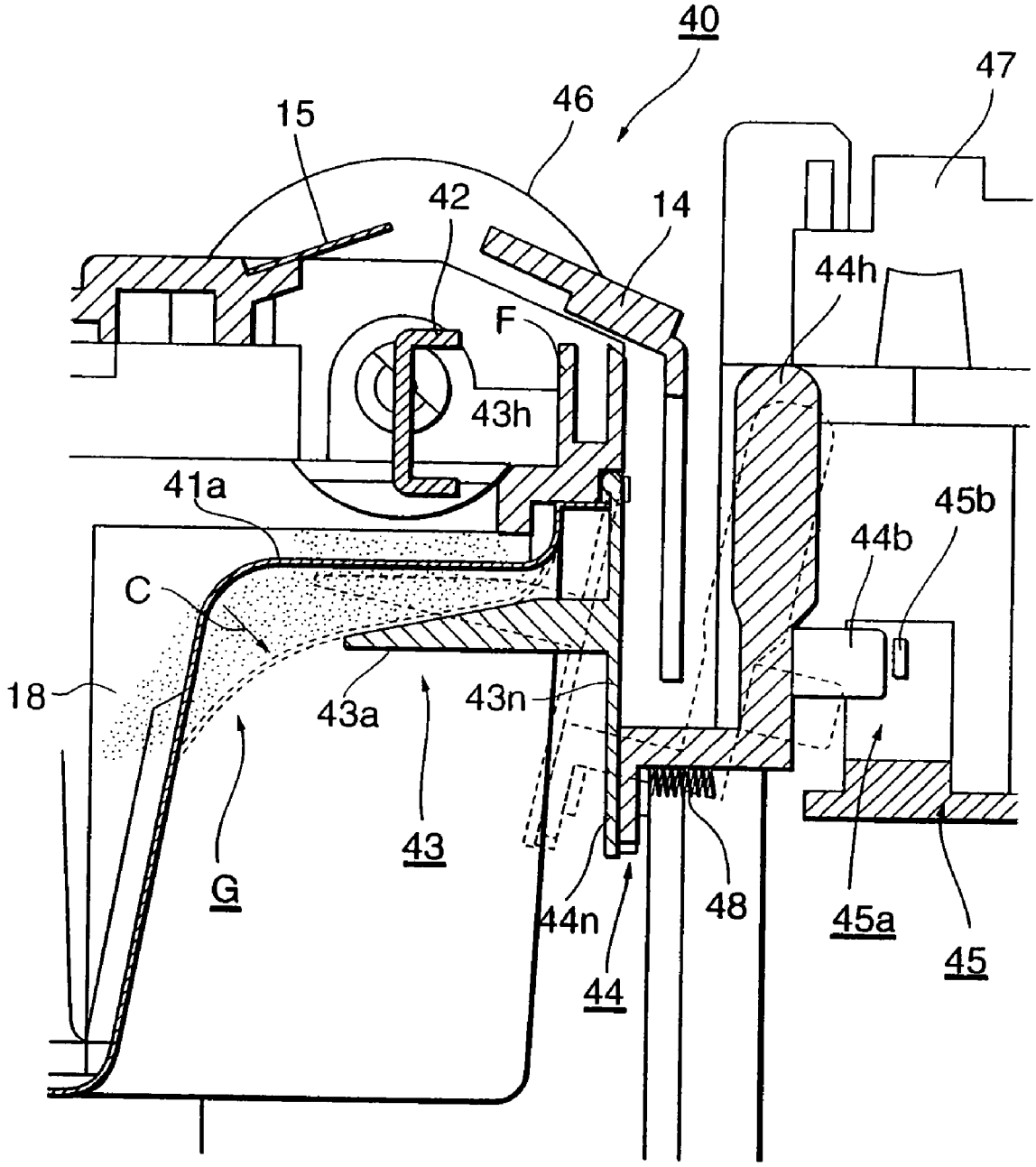
FIG. 10 is a cross sectional view showing the main portion of a collection box assembly of the present invention in embodiment 1.

FIG. 1 is a cross sectional view showing an collection box assembly of the present invention in embodiment 1; FIG. 7 is a squint drawing showing a collection box assembly of the present invention in embodiment 1; FIG. 8 is a first squint drawing showing a toner collecting section of the present invention in embodiment 1; FIG. 9 is a second squint drawing showing a toner collecting section of the present invention in embodiment 1; and FIG. 10 is a cross sectional view showing the main portion of a collection box assembly of the present invention in embodiment 1.

In these above drawings, 12 is a conveyance belt; 14 is a blade whose tip is set such as being pressed against the under surface of the conveyance belt 12 and which serves as the removing member for removing the toner 18*a* on the conveyance belt 12 by scraping up; 15 is a film which is set such as being pressed against the under surface of the conveyance belt 12 and is used for preventing the scraped toner from being scattered; 40 is a waste toner collecting section for collecting the scraped toner 18*a* as the waste toner 18.

The waste toner collecting section 40 comprises a frame F made up of a hard material such as a resin; a bag 41 which surrounds the frame F, has a opening and is made up of soft material (e.g. it is supple); and a cover 16 for covering the bag 41. The bag 41 may be made up of a material having bendable nature, for example, a resin such as polypropylene or polystyrene or the like, and may have the thickness of 0.2–0.3 mm.

Further, 42 is a stirring bar serving as a stirring member having a cross section with "コ"-shape, the stirring bar 42 is coupled with or fixed on a gear 46 made rotating by a driving section (not shown) used for stirring. A moving part 43 is a sensor lever serving as a detecting member, the sensor lever 43 comprises a hanging section 43*n* which hangs down from the frame F along the vertical direction and is supported such as rocking freely by surrounding the hinge 43*h* as rocking center, and a supporting section 43*a* which projects from the center of the hanging section 43*n* along the horizontal direction (the left direction in FIG. 10).

Moreover, 44 is a detecting lever (i.e. a moving part) serving as a detection connected member, the detecting lever 44 comprises a contacting section 44*n* contacting with the hanging section 43*n*. the contacting section 44*n* hangs down from a main chassis 47 serving as a chassis of the printing apparatus and is supported such as rocking freely by surrounding the hinge 44*h* as rocking center. Then, between the contacting section 44 and the main chassis 47, a spring 48 as an elastic member is set, the one end of the spring 48 is pressed by the contacting section 44*n*. Thus, the spring 48 gives a elastic force along the clockwise direction in FIG. 10 to the sensor lever 43 and the detecting lever 44. Moreover, the sensor lever 43, as shown by the broken line in FIG. 10, is stopped at a predetermined position by a limiter (not shown).

Further, 45 is a sensor substrate on which a photosensor 45*a* is installed. The photosensor 45*a* is set such as facing to a detection receiving portion 44*b* of the detecting lever 44.

As shown by FIGS. 8 and 9, the bag 41, at its upper edge 41*b*, is fixed to the frame F by an adhesive or the like. The frame F has some frame-portions for making the bag 41 keep a predetermined shape, therefor, the frame F is made up of a opening plate section Fa formed along the bottom surface Ba, the slanting surface Bb, the side surface Bc and Bd of the bag 41. In the opening plate section Fa, some hole portions f1 with predetermined shape are formed. Moreover, on between the back surface Be, a concave portion G is formed, serving as a displacement portion which is displaced by the weight and the pressure of the waste toner 18.

Next, to explain the operations of the collection box assembly 11 with the above construction.

First, to supply the power to start the printing. Thus, as shown by FIG. 1, while the conveyance belt 12 becomes moving along the arrow direction a, the toner 18*a* on the conveyance belt 12 is scraped up by the blade 14, then passes through between the film 15 and the blade 14 and falls down. The toner 18*a* is sent into the bag 41 by the stirring bar 42 rotating along an arrow direction B, and, serving as a waste toner 18, is piled up in the bag 14. A part of the toner 18 passes through the hole portions f1.

When the waste toner 18 is piled up and the piled amount in the waste toner collecting section 40 increases, the waste toner 18 rises over the upper surface 41*a* of the concave portion G of the bag 41. When the piled amount exceeds a threshold value, the concave portion G is displaced by the weight of the waste toner 18 and the upper surface 41*a* is pressed down along an arrow direction C. Thus, the stirring bar 42 rotates for pressing into the waste toner 18. Therefore, it is possible to collect sufficiently into the waste toner collecting section 40.

In the case, under the upper surface 41*a*, with the sensor lever 43 supporting the bag 41 by using the supporting section 43*a*, is made rotating along the counterclockwise direction against the direction of the elastic force of the spring 48, the detecting lever 44 is also made rotating along the counterclockwise direction. Thus, the detection receiving portion 44*b* shades the light emitting portion 45*b* of the potosensor 45*a*, therefore, the signal generated by the photosensor 45*a* is sent to a control section (not shown).

As a result, in the control section, a displacement detection process means performs a displacement detection process. That is, detecting the displacement of the concave G, stopping the operation of the printing apparatus or sending out an alarm. Thus, it is possible to inform the operator of that the waste toner 18 is filled and to stimulate the operator to exchange the collection box assembly 11. Moreover, the conveyance belt unit 10, the collection box assembly 11, the sensor lever 43, the detecting lever 44, the photo sensor 45*a* and the control section construct the toner collection apparatus.

As stated above, in this embodiment, the piled amount of the waste toner 18 in the waste toner collecting section 40 exceeds a threshold, the operation of the printing apparatus is stopped or an alarm is sent out, so there is nothing that the waste toner 18 overflows from the waste toner collecting section 40.

Moreover, the conveyance belt 12 is one of expendable supplies, it's absorbing function for sheet and its transferring function for toner become lower with repeating the printing operations. Therefore, while exchanging the collection box assembly 11, it is desired to exchange the conveyance belt 12. Therefor, the capacity of the waste toner collecting section 40 is set such as that the filling period of the waste toner 18 is approximately the same as, or is earlier than, the exchanging period of the conveyance belt 12. Therefore, it is possible to exchange the collection box assembly 11 before the function of the conveyance belt 12 becomes lower.

Embodiment 2

Next, to explain the embodiment 2 of the present invention.

Figure 11:
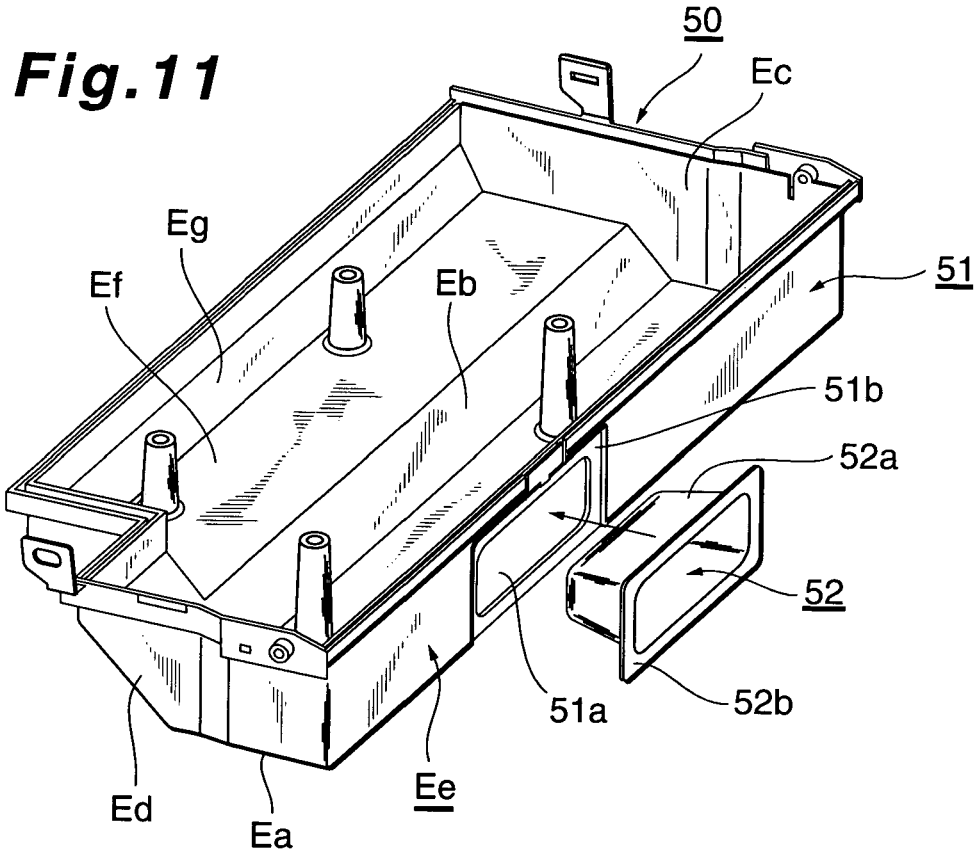
FIG. 11 is a first squint drawing showing the assembling state of a toner collecting section of the present invention in embodiment 2.
Figure 12:
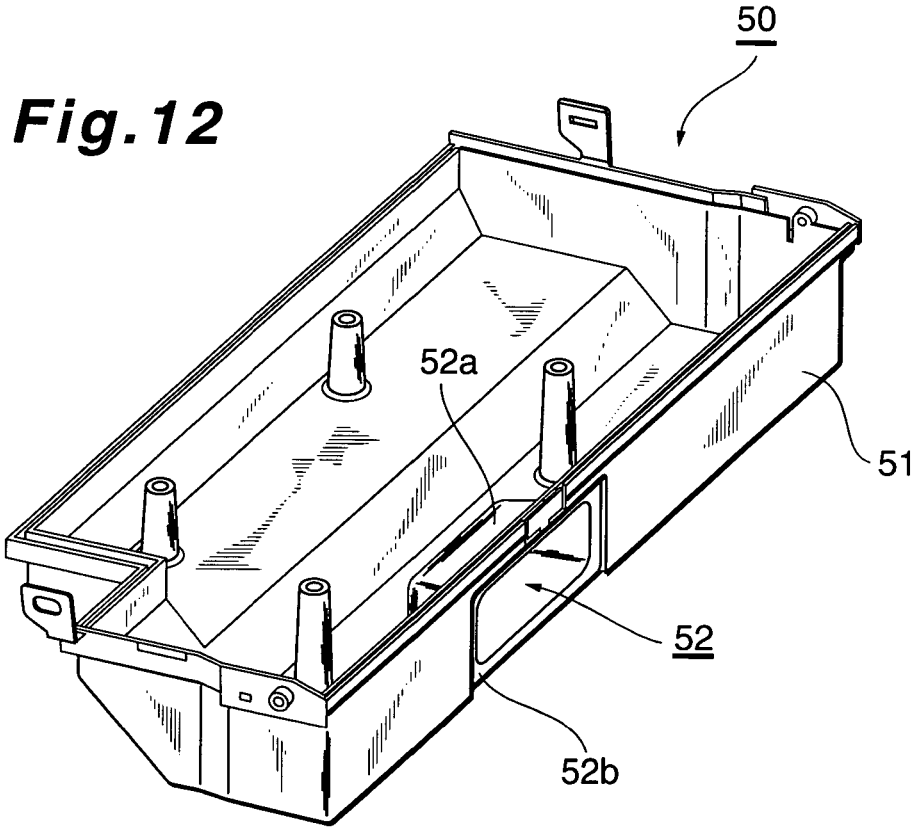
FIG. 12 is a second squint drawing showing the assembling state of a toner collecting section of the present invention in embodiment 2.
Figure 13:
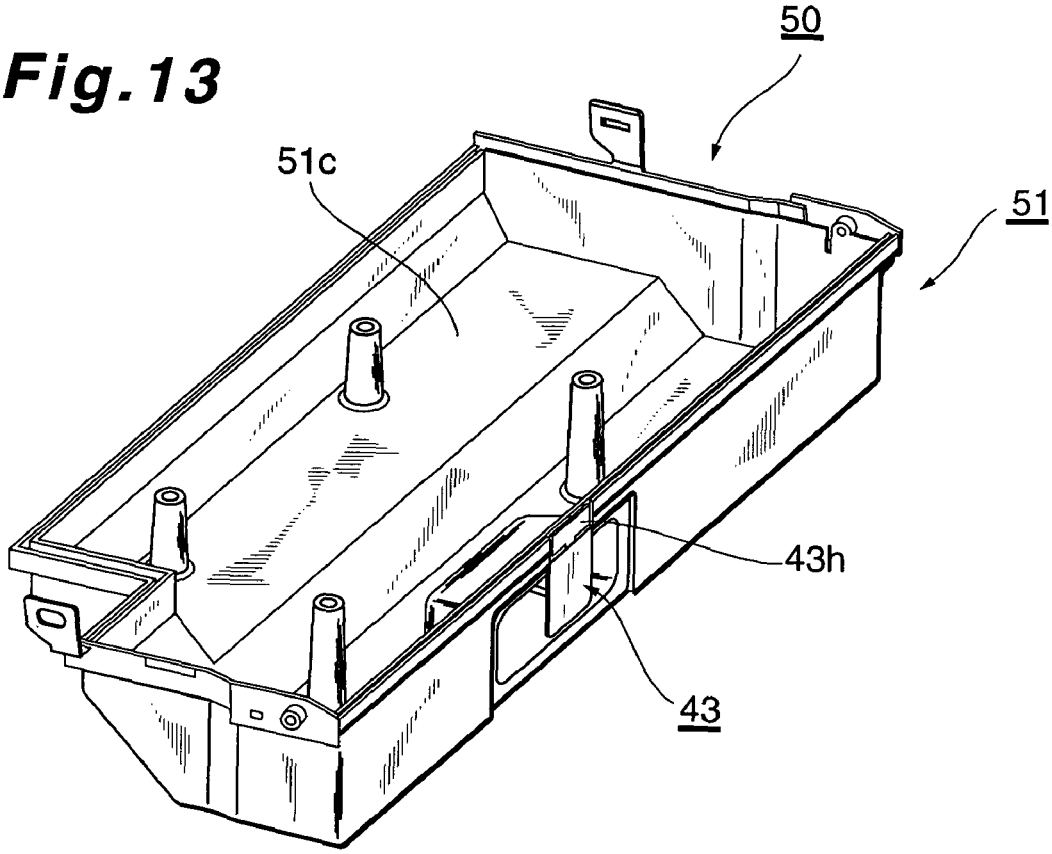
FIG. 13 is a squint drawing showing a toner collecting section of the present invention in embodiment 2.

FIG. 11 is a first squint drawing showing the assembling state of a toner collecting section of the present invention in embodiment 2; FIG. 12 is a second squint drawing showing the assembling state of a toner collecting section of the present invention in embodiment 2; FIG. 13 is a squint drawing showing a toner collecting section of the present invention in embodiment 2; and FIG. 14 is a cross sectional view showing a toner collecting section of the present invention in embodiment 2.

In these above drawings, 50 is a waste toner collecting section; 51 is a box made up of a hard material like resin. The box 51 includes a first bottom surface Ea, a first slanting surface Eb, a second bottom surface Ef, a second slanting surface Eg, side surfaces Ec and Ed, and a back surface Ee. On the about center of the back surface Ee, an opening is formed. Corresponding to the opening, a concave portion 51*b* with a predetermined depth is formed.

Further, 52 is a inserting member which is made up of a soft material like resin and inserts into the box 51 along the arrow direction in FIG. 11 via the opening 51*a*. The inserting member 52 includes a concave portion 52*a* serving as a displacement section displaced corresponding to the collecting capacity of the waste toner 18, and a flange portion 52*b*. The concave portion 52*a* enters the inside via the opening 51*a*, and the flange portion 52*b* contacts with the concave portion 51*b* and is fixed to the box 51 by adhesive or the like. The waste toner collecting section 50 is formed from the box 51 and the inserting member 52.

Figure 14:
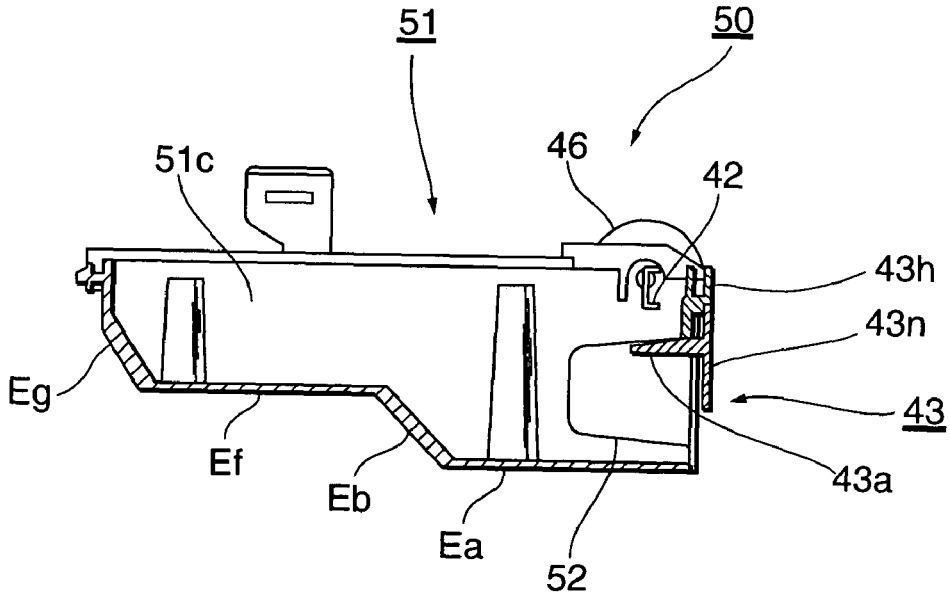
FIG. 14 is a cross sectional view showing a toner collecting section of the present invention in embodiment 2.

Moreover, 43 is a sensor lever serving as a detecting member, the sensor lever 43 comprises a hanging section 43*n* which hangs down from the opening 51*a* of the box 51 along the vertical direction and is supported such as rocking freely by surrounding the hinge 43*h* as rocking center, and a supporting section 43*a* which projects from the center of the hanging section 43*n* along the horizontal direction (the left direction in FIG. 14).

Further, 42 is a stirring bar serving as a stirring member; and 46 is a gear. Moreover, on the box 51, an extending portion 51*c* is formed for increasing the capacity.

Regarding the operations of the collection box assembly 11 (FIG. 1) in the second embodiment, their explanation are omitted due to the same as that in the first embodiment.

As described above, in the embodiment, because the inserting member 52 is placed into the center of the back surface Ee, the inserting member 52 can be made become very small. Therefore, it is possible to increase the capacity of the toner 18 in the waste toner collecting section 50.

Further, because the inserting member 52 can be installed easily, it is possible to reduce the cost of the collection box assembly 11 and to simplify the exchanging work of the collection box assembly 11. Moreover, because box 51 is formed from the hard resin, the handling becomes easy.

Embodiment 3

Next, to explain the third embodiment of the present invention.

In the embodiment 3, with respect to the same composition elements as that in the above embodiments, they will be given the same symbol. Further, the same some explanation will be omitted.

Figure 15:
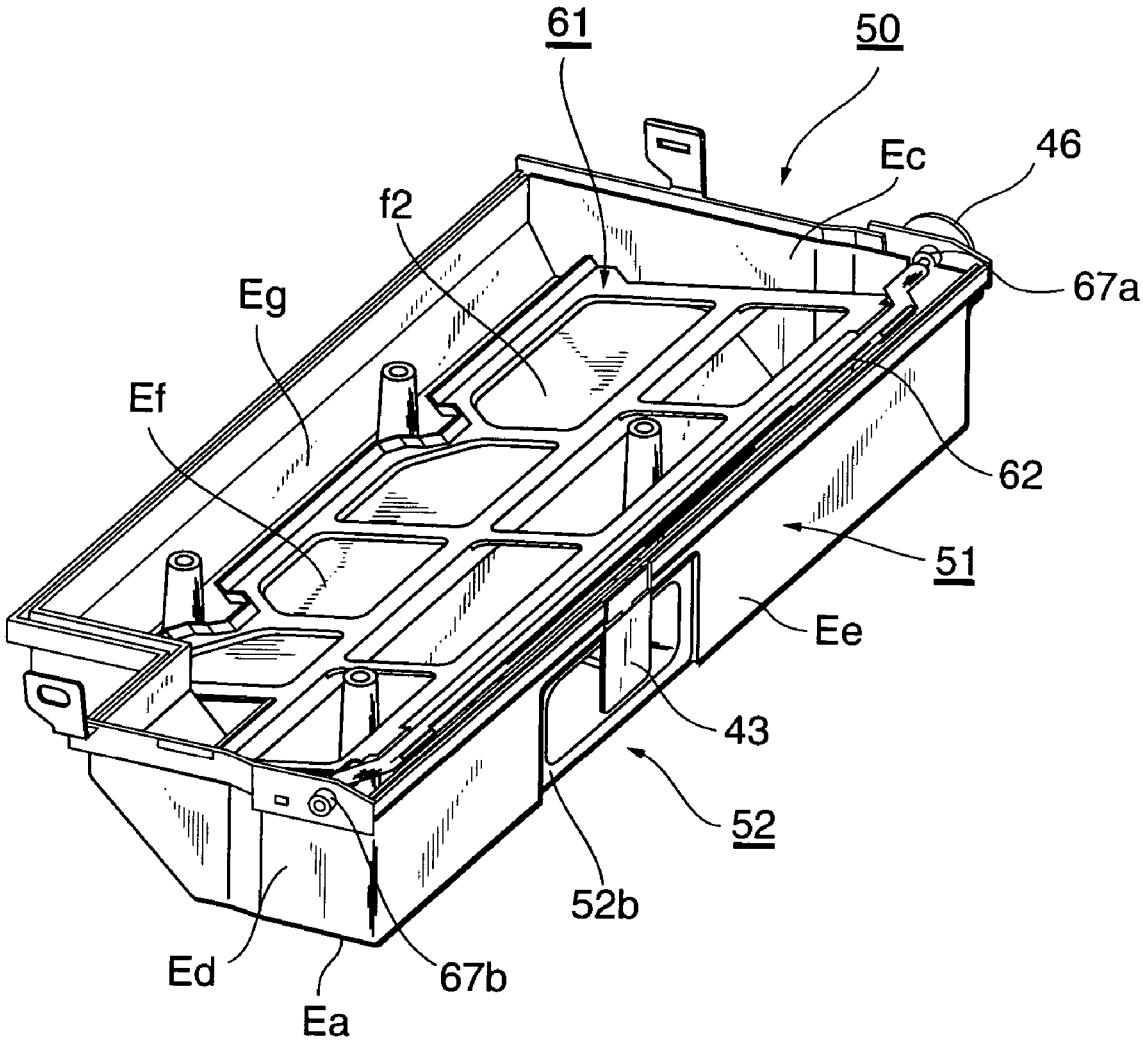
FIG. 15 is a squint drawing showing a toner collecting section of the present invention in embodiment 3.

FIG. 15 is a squint drawing showing a toner collecting section of the present invention in embodiment 3; FIG. 16 is a squint drawing showing a stirring member of the present invention in embodiment 3; FIG. 17 is a squint drawing showing the main portion of a stirring member of the present invention in embodiment 3; FIG. 18 is a squint drawing showing the installing state of a second connection section of the present invention in embodiment 3; and FIG. 19 is a cross sectional view showing a stirring member of the present invention in embodiment 3.

In these above drawings, 50 is a waste toner collecting section; 61 is a stirring member is set slantly in the box 51 made up of a hard material like resin, and is set such as sliding freely. The upper portion of the stirring member 61 rotates by surrounding a predetermined axis, and the under portion of the stirring member 61 rocks with respect to the second bottom surface Ef. On the stirring member 61, a hole portion f2 with predetermined shape is formed.

Further, 62 is a shaft installed such as coupling with the stirring member 61 by coupling portions 61*a* and 61*b* formed at the upper part of stirring member.

Then, on the side surfaces Ec and Ed, a first and second fulcrum portions with sleeve shape 67*a* and 67*b* are supported such as rotating freely. On the first fulcrum portion 67*a*, the gear 46 is installed controlled by a driving section (not shown). Moreover, on the two ends of the shaft 62, corresponding to the first and second fulcrum portions 67*a* and 67*b*, first and second connection sections 63 and 64 having cross section with "コ"-shape are fixed by screws 65 and 66 serving as fixing member. Therefor, screw holes h1 and h2 are formed respectively at the first and second connection sections 63 and 64, and the two ends of the shafts 62.

Further, on the first and second connection sections 63 and 64, a rotating axis portion sh is formed at the position which deviates from the center of the shaft 62, such as projecting from the shaft 62. By the shaft 62 and the first and second connection sections 63 and 64, a axis unit with crank shape is constructed. Then, the rotating axis portion sh is inserted into the coupling hole in the first and second fulcrum portions 67*a* and 67*b*, and the first and second connection sections 63, 64 and the first and second fulcrum portions 67*a*, 67*b* are connected as rotating impossibly each other and construct a rotation transmitting section.

Therefore, when the gear 46 is made rotating by a driving section for stirring, the rotation of the first and second fulcrum portions 67*a* and 67*b* is transmitted to the rotating axis portion sh, the shaft 62, as shown by FIG. 19, circles the circumference the center of the gear 46 and the first and second fulcrum portions 67*a* and 67*b* along the arrow direction K by keeping a predetermined distance. With this, the stirring member 61 moves along the arrow directions L and M.

Next, to explain the operations of the collection box assembly 11 (FIG. 1) with the above construction.

First, when the power supply is turned on, the printing starts and the driving section drives, the shaft 62 circles the circumference the center of the gear 46 and the first and second fulcrum portions 67*a* and 67*b* along the direction K. With this, the stirring member 61 coupled with the shaft 62, with respect to the second bottom surface Ef, while its under end slides, rocks by surrounding the the under end serving as a rocking center along the arrow direction M.

Thus, the waste toner 18 piled up in the box 51, is sent into the inner part by the projecting portions 61*c*–61*f* formed under the stirring member 61. Further, with the circling operation of the shaft 62, the projecting portion 61*c* and 61*d* press the toner over the inserting member 52 in the box 51 into the inserting member 52.

As described above, in the embodiment, by making the stirring member 61 rock, the waste toner 18 can be piled up equally on the whole area of the box 51. Therefore, it is possible to collecting the waste toner 18 sufficiently into the waste toner collecting section 50.

Embodiment 4

Next, to explain an embodiment 4 of the present invention.

In the embodiment 4, with respect to the same composition elements as that in the above embodiments, they will be given the same symbol. Further, the same some explanation will be omitted.

Figure 20:
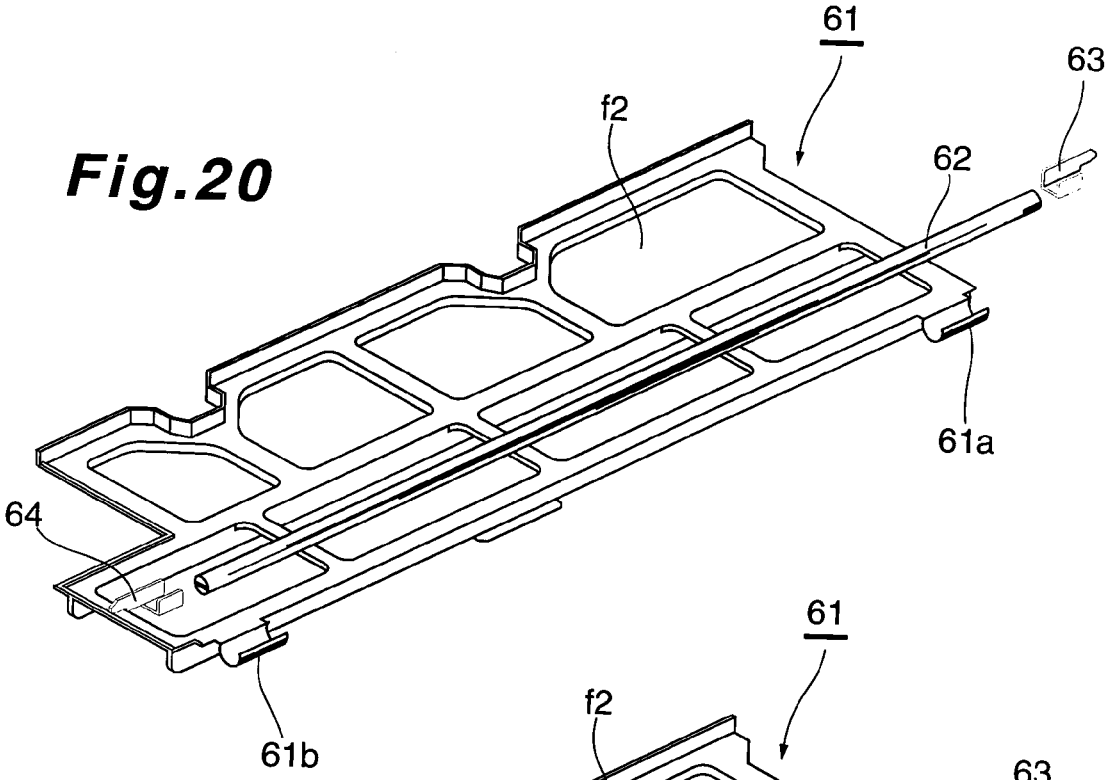
FIG. 20 is a squint drawing showing the assembling state of a stirring member of the present invention in embodiment 4.
Figure 21:
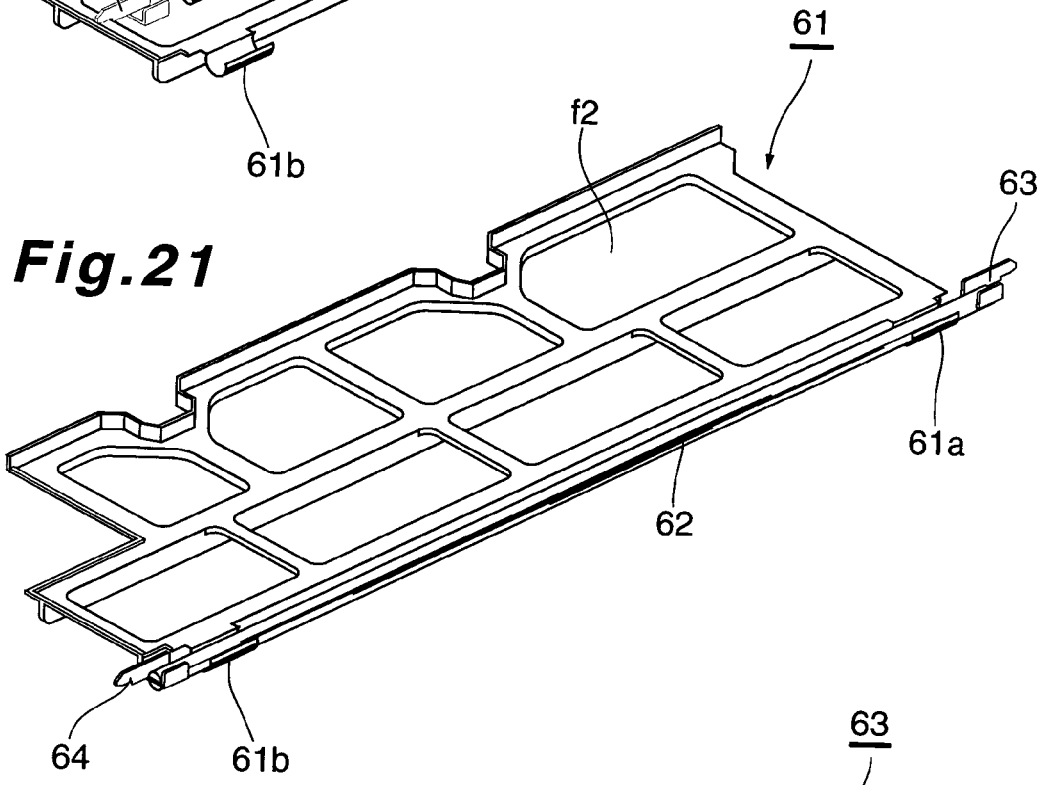
FIG. 21 is a squint drawing showing a stirring member of the present invention in embodiment 4.
Figure 22:
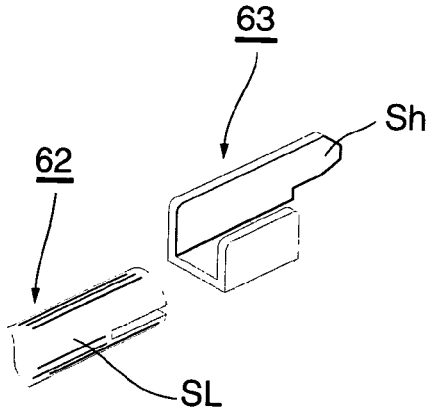
FIG. 22 is a squint drawing showing the installing state of a first connection section of the present invention in embodiment 4.

FIG. 20 is a squint drawing showing the assembling state of a stirring member of the present invention in embodiment 4; FIG. 21 is a squint drawing showing a stirring member of the present invention in embodiment 4; and FIG. 22 is a squint drawing showing the installing state of a first connection section of the present invention in embodiment 4.

In these above drawings, 61 is a stirring member is set slantly in the box 51 (FIG. 15) made up of a hard material like resin, and is set such as sliding freely. The upper portion of the stirring member 61 rotates by surrounding a predetermined axis, and the under portion of the stirring member 61 rocks with respect to the second bottom surface Ef. On the stirring member 61, a hole portion f2 with predetermined shape is formed.

Further, 62 is a shaft installed such as coupling with the stirring member 61 by coupling portions 61*a* and 61*b* formed at the upper part of stirring member.

Then, on the side surfaces Ec and Ed, a first and second fulcrum portions with sleeve shape 67*a* and 67*b* are supported such as rotating freely. On the first fulcrum portion 67*a*, the gear 46 is installed controlled by a driving section (not shown). Moreover, on the two ends of the shaft 62, corresponding to the first and second fulcrum portions 67*a* and 67*b*, first and second connection sections 63 and 64 having cross section with "コ"-shape are fixed by slit SL serving as fixing member.

Further, on the first and second connection sections 63 and 64, a rotating axis portion sh is formed at the position which deviates from the center of the shaft 62, such as projecting from the shaft 62. By the shaft 62 and the first and second connection sections 63 and 64, a axis unit with crank shape is constructed. Then, the rotating axis portion sh is inserted into the coupling hole in the first and second fulcrum portions 67*a* and 67*b*, and the first and second connection sections 63, 64 and the first and second fulcrum portions 67*a*, 67*b* are connected as rotating impossibly each other and construct a rotation transmitting section.

Moreover, here, regarding the operations of the collection box assembly 11 (FIG. 1) with the above construction, their explanations are omitted.

As stated above, in the embodiment, because that used to fix the first and second connection sections 63 and 64 on the shaft 62 is the slit SL, but is not the screw 65 and 66, it is possible to reduce the parts of the collection box assembly 11. Therefore, the cost of the collection box assembly 11 can be reduced.

Embodiment 5

Next, to explain an embodiment 5 of the present invention.

In the embodiment 5, with respect to the same composition elements as that in the above embodiments, they will be given the same symbol. Further, the same some explanation will be omitted.

Figure 23:
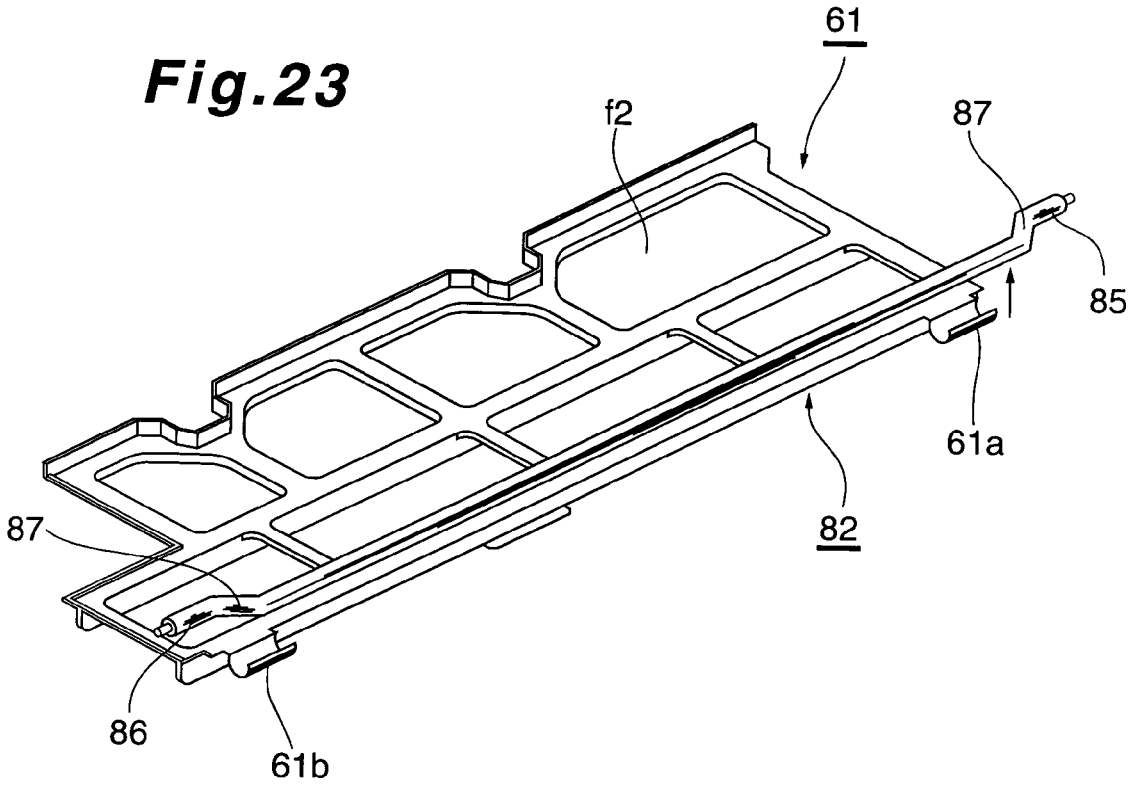
FIG. 23 is a squint drawing showing the assembling state of a stirring member of the present invention in embodiment 5.
Figure 24:
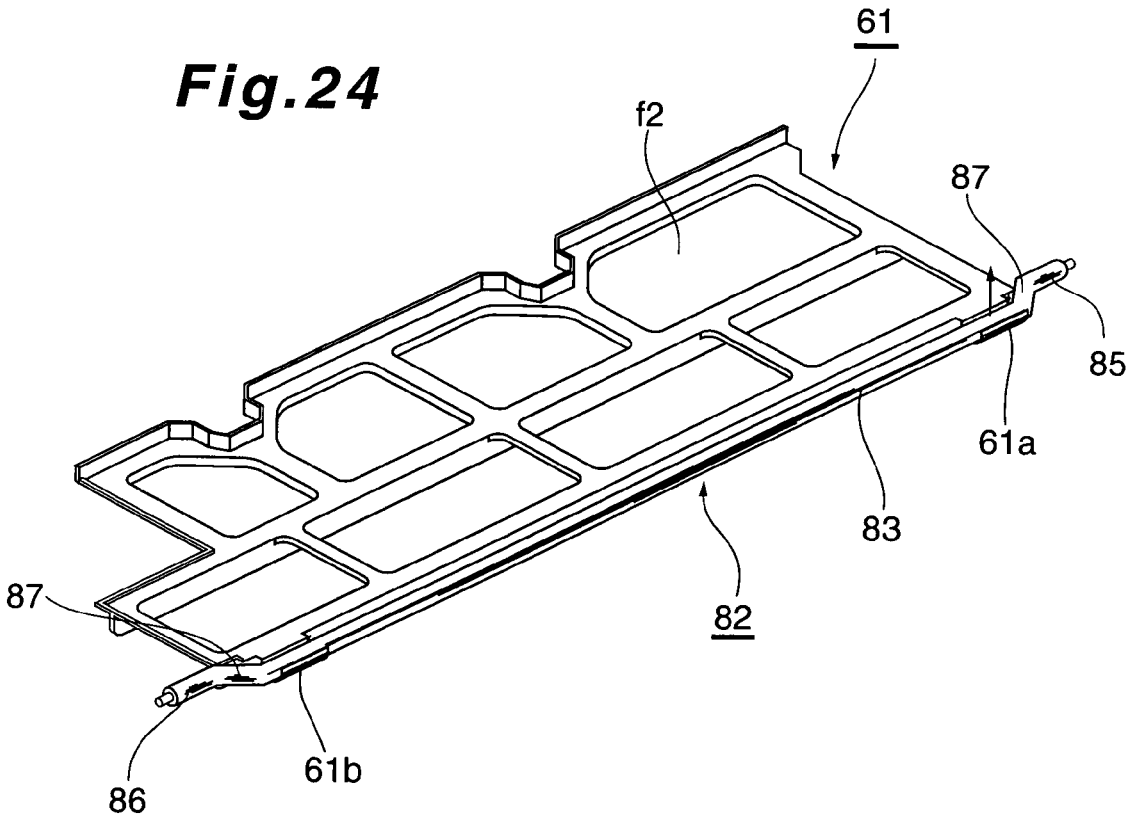
FIG. 24 is a squint drawing showing a stirring member of the present invention in embodiment 5.

FIG. 23 is a squint drawing showing the assembling state of a stirring member of the present invention in embodiment 5; and FIG. 24 is a squint drawing showing a stirring member of the present invention in embodiment 5.

In these above drawings, 61 is a stirring member is set slantly in the box 51 (FIG. 15) made up of a hard material like resin, and is set such as sliding freely. The upper portion of the stirring member 61 rotates by surrounding a predetermined axis, and the under portion of the stirring member 61 rocks with respect to the second bottom surface Ef. On the stirring member 61, a hole portion f2 with predetermined shape is formed.

Further, 82 is a shaft installed such as coupling with the stirring member 61 by coupling portions 61*a* and 61*b* formed at the upper part of stirring member.

Then, on the side surfaces Ec and Ed, a first and second fulcrum portions with sleeve shape 67*a* and 67*b* are supported such as rotating freely. On the first fulcrum portion 67*a*, the gear 46 is installed controlled by a driving section (not shown). Moreover, on the two ends of the shaft 82, corresponding to the first and second fulcrum portions 67*a* and 67*b*, first and second connection sections 85 and 86 deviate from the axis center of the shaft body 83, and are formed in a body via a slanting portion 87. Thus, the shaft 82 and the first and second connection sections 85, 86 constructed a axis unit with crank shape.

Moreover, here, regarding the operations of the collection box assembly 11 (FIG. 1) with the above construction, their explanations are omitted.

As stated above, in the embodiment, because the shaft body 83, the first and second connection sections 85 and 86 are formed in a body, it is possible to reduce the parts of the collection box assembly 11. Further, the cost of the collection box assembly 11 can be reduced.

According to the present invention, the toner collection apparatus comprises a removing member for removing the toner in the toner carrier; a toner collecting section which is used for collecting the toner and has displacement section displaced corresponding to the piled amount of the toner; and the detecting section for detecting the displacement of the displacement section.

Then, because the displacement corresponding to the piled amount of the toner can be detected, it is possible to collecting sufficiently the toner in the toner collecting section. So that it is possible to prevent the toner from overflowing from the toner collecting section.

The present invention is not limited to the foregoing embodiments but many modifications and variations are possible within the spirit and scope of the appended claims of the invention.

What is claimed is:

1. An apparatus for collecting toner, comprising:

a removing member for removing the toner from a toner carrier;

a toner collector which is used for collecting the toner, the toner collector comprising a rigid portion and a supple portion which transforms corresponding to an amount of the toner accumulated in the toner collector;

a moving part which contacts the supple portion and moves under the toner accumulated in the toner collector as the supple portion is transformed; and a movement detector detecting the displacement of the moving part;

wherein the supple portion includes an upper portion, in contact with the moving part, on which the toner accumulates, and wherein, the upper portion carries at least a portion of the moving part downward under the weight of the toner; said apparatus also comprising a stirring member for stirring the toner, which is placed over the upper portion of said supple portion, and conveys the toner from a place over said upper portion of said supple portion to the inside of said toner collector.

2. The apparatus for collecting toner according to claim 1, wherein said toner collector includes a box-shape section; and an inserting member which is made up of a supple material and inserts into said box-shape section, wherein said supple portion is formed from said inserting member.

3. The apparatus for collecting toner according to claim 1, further comprising:

wherein the stirring member rocks freely in said toner collector.

4. The apparatus for collecting toner according to claim 1, wherein the displacement of the moving part includes a rotation.

5. The apparatus for collecting toner according to claim 1, wherein the removing member is disposed above the supple portion which transforms.

6. The apparatus for collecting toner according to claim 1, wherein said upper portion of said supple portion is placed at a position which is higher than the bottom of said toner collector.

7. An apparatus for collecting toner, comprising:

a removing member for removing the toner from a toner carrier;

a toner collector which is used for collecting the toner, the toner collector comprising a rigid portion and a supple portion which transforms corresponding to an amount of the toner accumulated in the toner collector;

a moving part which contacts the supple portion and moves under the toner accumulated in the toner collector as the supple portion is transformed; and a movement detector detecting the displacement of the moving part;

wherein said toner collector includes a frame; and a bag-shape section which is made up of a supple material and surrounds said frame, wherein said supple portion is formed from said bag-shape section.

8. An apparatus for collecting toner, comprising:

a removing member for removing the toner from a toner carrier;

a toner collector which is used for collecting the toner, the toner collector comprising a rigid portion and a supple portion which transforms corresponding to an amount of the toner accumulated in the toner collector;

a stirring member which rocks freely in said toner collector;

a moving part which contacts the supple portion and moves under the toner accumulated in the toner collector as the supple portion is transformed; and a movement detector detecting the displacement of the moving part;

wherein the supple portion includes an upper portion, in contact with the moving part, on which the toner accumulates, and wherein, the upper portion carries at least a portion of the moving part downward under the weight of the toner;

wherein said stirring member is set slantly, the upper end of said stirring member is supported by an axis unit with crank axis shape, said stirring member is made rocking by the rotation of said axis unit, and the upper end of the stirring member is placed over the upper part of the supple portion.

9. The apparatus for collecting toner according to claim 8, wherein said axis unit comprises a shaft body and a connecting section formed integrally with said shaft body.

10. The apparatus for collecting toner according to claim 8, wherein said axis unit is made up of a shaft and a connecting section installed at the two ends of said shaft.

11. The apparatus for collecting toner according to claim 10, wherein said connecting section has a rotation axis portion formed such as deviating from the center of said shaft.

12. An apparatus for collecting toner, comprising:

a conveyance member contacting with an image forming unit;

a removing member for removing the toner from the conveyance member;

a toner collector which is used for collecting the toner, the toner collector comprising a rigid portion and a supple portion which transforms corresponding to an amount of the toner accumulated in the toner collector;

a moving part which contacts the supple portion and moves under the toner accumulated in the toner collector as the supple portion is transformed; and a movement detector detecting the displacement of the moving part;

wherein the supple portion includes an upper portion, in contact with the moving part, on which the toner accumulates, and wherein, the upper portion carries at least a portion of the moving part downward under the weight of the toner; said apparatus also comprising a stirring member for stirring the toner, which is placed over the upper portion of said supple portion, and conveys the toner from a place over said upper portion of said supple portion to the inside of said toner collector.

13. The apparatus for collecting toner according to claim 12, wherein said toner collector includes a box-shape section; and an inserting member which is made up of a supple material and inserts into said box-shape section, wherein said supple portion is formed from said inserting member.

14. The apparatus for collecting toner according to claim 12, further comprising:

wherein the stirring member which rocks freely in said toner collector.

15. The apparatus for collecting toner according to claim 12, wherein the displacement of the moving part includes a rotation.

16. The apparatus for collecting toner according to claim 12, wherein said upper portion of said supple portion is placed at a position which is higher than the bottom of said toner collector.

17. An apparatus for collecting toner, comprising:

a conveyance member contacting with an image forming unit;

a removing member for removing the toner from the conveyance member;

a toner collector which is used for collecting the toner, the toner collector comprising a rigid portion and a supple portion which transforms corresponding to an amount of the toner accumulated in the toner collector;

a moving part which contacts the supple portion and moves under the toner accumulated in the toner collector as the supple portion is transformed; and a movement detector detecting the displacement of the moving part;

wherein said toner collector includes a frame; and a bag-shape section which is made up of a supple material and surrounds said frame, wherein said supple portion is formed from said bag-shape section.

18. An apparatus for collecting toner, comprising:

a conveyance member contacting with an image forming unit;

a removing member for removing the toner from the conveyance member;

a toner collector which is used for collecting the toner, the toner collector comprising a rigid portion and a supple portion which transforms corresponding to an amount of the toner accumulated in the toner collector;

a stirring member which rocks freely in said toner collector;

a moving part which contacts the supple portion and moves under the toner accumulated in the toner collector as the supple portion is transformed; and a movement detector detecting the displacement of the moving part;

wherein the supple portion includes an upper portion, in contact with the moving part, on which the toner accumulates, and wherein, the upper portion carries at least a portion of the moving part downward under the weight of the toner;

wherein said stirring member is set slantly, the upper end of said stirring member is supported by an axis unit with crank axis shape, said stirring member is made rocking by the rotation of said axis unit, and the upper end of the stirring member is placed over the upper part of the supple portion.

19. The apparatus for collecting toner according to claim 18, wherein said axis unit comprises a shaft body and a connecting section formed integrally with said shaft body.

20. The apparatus for collecting toner according to claim 18, wherein said axis unit is made up of a shaft and a connecting section installed at the two ends of said shaft.

21. The apparatus for collecting toner according to claim 20, wherein said connecting section has a rotation axis portion formed such as deviating from the center of said shaft.

* * * * *